US005095922A

United States Patent [19]

Johnson et al.

[11] Patent Number: 5,095,922

[45] Date of Patent: Mar. 17, 1992

[54] PROCESS FOR INCREASING THE FILLING POWER OF TOBACCO MATERIAL

[75] Inventors: Robert C. Johnson, Winston-Salem; Dale B. Poindexter, East Bend; John E. Stewart, Winston-Salem, all of N.C.

[73] Assignee: R. J. Reynolds Tobacco Company, Winston-Salem, N.C.

[21] Appl. No.: 505,339

[22] Filed: Apr. 5, 1990

[51] Int. Cl.[5] ..... A24B 3/18; A24B 15/24; A24B 15/26

[52] U.S. Cl. ..... 131/216; 131/291; 131/297; 131/298

[58] Field of Search ..... 131/297, 298, 291, 292, 131/293, 294, 295, 296

[56] References Cited

U.S. PATENT DOCUMENTS

| | | | |
|---|---|---|---|
| 2,770,239 | 11/1956 | Prats | 131/297 |
| 3,524,451 | 8/1970 | Fredrickson . | |
| 3,524,452 | 8/1970 | Moser et al. . | |
| 3,693,631 | 9/1972 | Moore et al. . | |
| 3,771,533 | 11/1973 | Armstrong et al. . | |
| 4,165,012 | 8/1979 | Markwood . | |
| 4,235,250 | 11/1980 | Utsch . | |
| 4,258,729 | 3/1981 | de la Burde et al. . | |
| 4,295,337 | 10/1981 | Johnson et al. . | |
| 4,307,735 | 12/1981 | Snow et al. . | |
| 4,308,876 | 1/1982 | Rothchild . | |
| 4,312,369 | 1/1982 | Mullen et al. . | |
| 4,336,814 | 6/1982 | Sykes et al. . | |
| 4,340,073 | 7/1982 | de la Burde et al. . | |
| 4,366,824 | 1/1983 | Rainer et al. . | |
| 4,366,825 | 1/1983 | Utsch et al. . | |
| 4,377,173 | 3/1983 | Rothchild . | |
| 4,459,100 | 7/1984 | de la Burde et al. . | |
| 4,531,529 | 7/1985 | White et al. . | |
| 4,574,819 | 3/1986 | Rainer et al. . | |
| 4,641,665 | 2/1987 | Hedge et al. . | |
| 4,696,313 | 9/1987 | Brown et al. . | |
| 4,991,596 | 2/1991 | Lawrence et al. . | |

*Primary Examiner*—V. Millin
*Attorney, Agent, or Firm*—A. J. Borschke

[57] ABSTRACT

Tobacco cut filler has an extremely high filling capacity. Tobacco cut filler is contacted with tap water under extraction conditions, and resulting aqueous tobacco extract is separated from the water insoluble extracted tobacco material. The extracted tobacco material is contacted with humectant, provided at a desired moisture level, and subjected to volume expansion conditions. Volume expanded extracted tobacco materials are used as smokable materials in cigarette manufacture.

50 Claims, 1 Drawing Sheet

PROCESS FOR INCREASING THE FILLING POWER OF TOBACCO MATERIAL

BACKGROUND OF THE INVENTION

The present invention relates to a process for expanding a tobacco material, and more particularly to a process for increasing the filling power of a tobacco material.

When tobacco material is processed for use as cut filler for the manufacture of cigarettes, the density of that material increases relative to the density of that material in a natural condition. Thus, processed tobacco material used in cigarette manufacture often has a density greater than necessary for producing acceptable cigarettes. There have been proposed various processes for reducing the density of processed tobacco materials in order to reduce the weight of tobacco material employed in manufacturing each cigarette. See, for example, the various tobacco expansion processes described in U.S. Pat. Nos. 3,524,451 (Re. 30,693) to Fredrickson; 3,524,452 to Moser et al; 3,683,937 to Fredrickson et al; 3,771,533 to Armstrong; 4,235,250 to Utsch; 4,258,729 to de la Burde et al; 4,336,814 (Re. 32,014) to Sykes et al; 4,340,073 (Re. 32,013) to de la Burde et al; 4,531,529 to White et al; 4,574,819 to Rainer et al; 4,366,824 to Rainer et al; 4,459,100 to de la Burde et al; 4,641,655 to Hedge et al and 4,696,313 to Brown et al.

Expanded processed tobacco materials have densities which are reduced and filling powers which are increased relative to similarly processed tobacco materials which have not been subjected to an expansion process. By "filling power" is meant the ability of a smokable filler material, at a particular moisture level and temperature, to form a firm smokable rod for a cigarette. Methods of determining the filling power of tobacco materials are set forth in *Tobacco Encyclopedia,* edited by Voges, p. 457, TJI (1984).

It would be highly desirable to provide a process for expanding a tobacco material in order to increase, to a very high degree, the filling power of that material.

SUMMARY OF THE INVENTION

The present invention relates to a process for increasing the filling power of a tobacco material. The process involves extracting components from a tobacco material using a solvent so as to provide (i) a tobacco extract within the solvent, and (ii) an extracted tobacco material. The extracted tobacco material, which is separated from at least a portion of the extract and solvent, then is subjected to volume expansion conditions. In a highly preferred aspect of the present invention, the extracted tobacco material is contacted with humectant prior to being subjected to the expansion conditions.

The manner in which the extracted tobacco material is subjected to expansion conditions can vary, and a variety of techniques for volume expanding the tobacco material can be employed. Preferably, the extracted tobacco material is provided in contact with (e.g., impregnated with) an expansion agent, and the expansion agent then is released from contact with the extracted tobacco material so as to expand that tobacco material.

In a preferred aspect of the present invention, tobacco material (e.g., in cut filler form) is subjected to extraction conditions using a solvent having an aqueous character so as to provide (i) an aqueous tobacco extract, and (ii) an essentially water insoluble extracted tobacco material. A typical water insoluble tobacco material includes components of the biopolymer matrix of the tobacco material (e.g., cellulosics), and other materials which are not soluble in the solvent or are not otherwise extracted by the solvent. The extracted tobacco material is separated from a significant portion of the aqueous tobacco extract. Then, the extracted tobacco material, which typically is in a moist state, is contacted with a humectant (e.g., a polyhydric alcohol). Such a tobacco material then is subjected to volume expansion conditions.

The process of the present invention provides the skilled artisan with an efficient and effective method for providing tobacco filler materials having extremely low densities and extremely high filling capacities. Such tobacco filler materials are particularly useful as smokable materials for the manufacture of cigarettes.

DETAILED DESCRIPTION OF THE PREFERRED EMBODIMENTS

Figure 1:
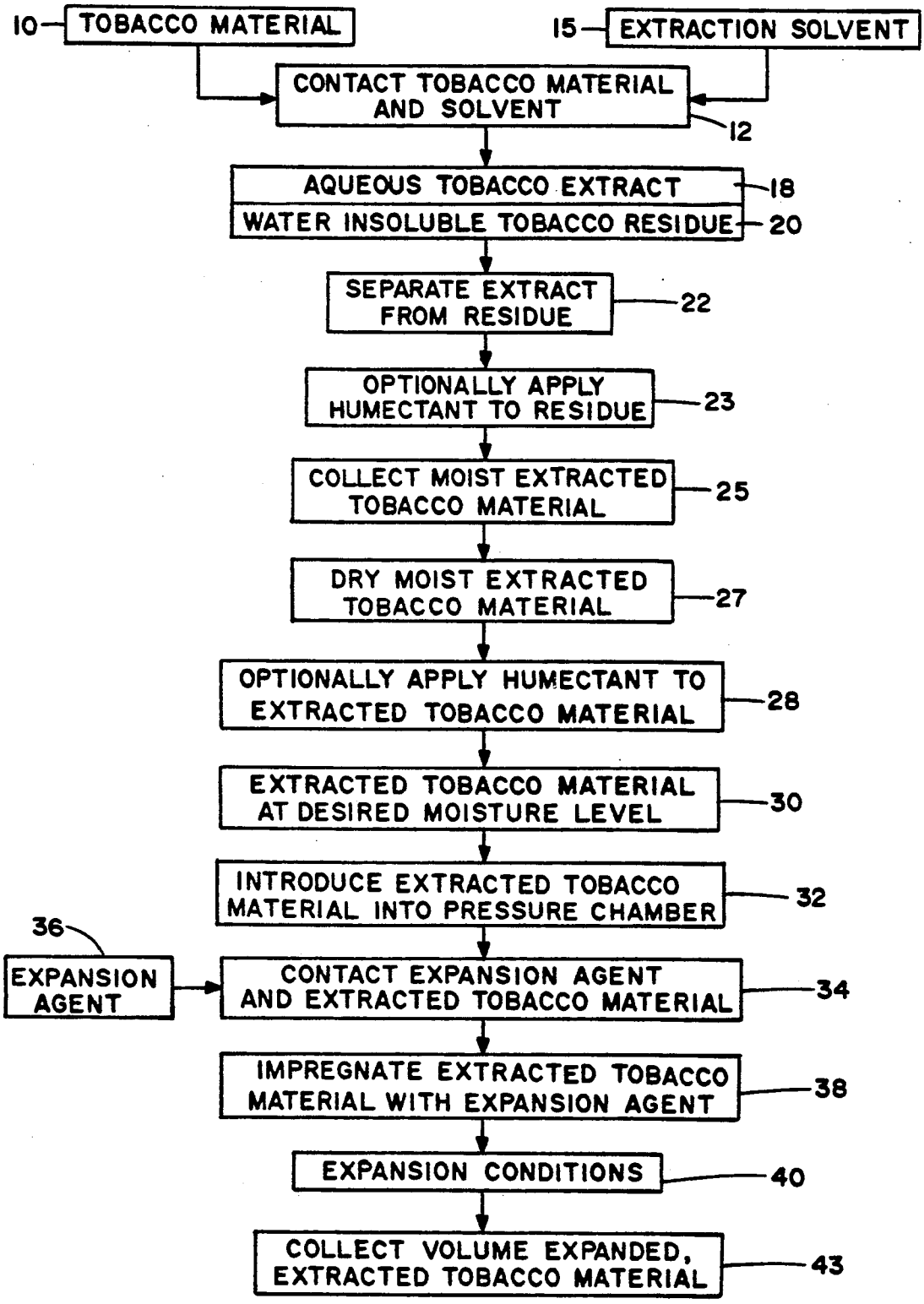
FIG. 1 is a schematic diagram of the process steps representative of one embodiment of the present invention.

Referring to FIG. 1, tobacco material 10, such as tobacco cut filler, is contacted 12 with an extraction solvent 15 having an aqueous character. As such, various soluble components are extracted from the tobacco material 10 yielding an aqueous tobacco extract 18 and a water insoluble tobacco residue 20. The aqueous tobacco extract 18 is separated 22 from the insoluble tobacco residue 20 using centrifugation techniques, or the like. If desired, a humectant 23 can be applied to the insoluble tobacco residue. As such, a moist extracted tobacco cut filler is collected 25. A further amount of aqueous tobacco extract can be separated from the insoluble tobacco residue using a disk press, or the like. The collected moist insoluble tobacco residue 25 is dried 27 to a moisture level of about 15 to about 50 percent, based on the total weight of the moist extracted cut filler which is collected. If desired, a humectant 28 can be applied to the moist extracted cut filler. As such, an extracted tobacco material having a desired moisture content 30 is provided.

The extracted tobacco material 30 is charged into a pressure chamber 32 and contacted 34 with an expansion agent 36 (e.g., monofluorotrichloromethane) in such a manner that the expansion agent impregnates 38 the extracted tobacco material. In particular, the extracted tobacco material is contacted with an expansion agent which is maintained at a fairly high pressure relative to atmospheric pressure. The resulting extracted tobacco material thereby is impregnated with expansion agent. The extracted tobacco material which is impregnated with the expansion agent then is subjected to expansion conditions 40. Expansion conditions involve rapidly heating impregnated extracted tobacco material while rapidly releasing the pressure experienced by the expansion agent which contacts the tobacco material. As such, volume expanded, extracted tobacco material 43 is provided.

The tobacco material which is processed according to the present invention can vary. Suitable types of tobaccos include flue-cured, Burley, Oriental and Maryland tobaccos, as well as the rare and specialty tobaccos. Normally, the tobacco material has been aged. The form of the tobacco material can vary. The tobacco can be in the form of whole leaf, strip (i.e., predominantly tobacco leaf laminae), stem, cut filler (e.g., strands or shreds of laminae normally provided from tobacco strip), shredded stem, or cut-rolled stem. In highly preferred aspects of the present invention, the tobacco material is in a cut filler form. Typical cut filler has a width which ranges from about 1/20 inch to about 1/50 inch, preferably from about 1/25 inch to about 1/35 inch; and a length which ranges from about 0.25 inch to about 3 inches. The tobacco material which is processed according to the present invention is of a form such that, under extraction conditions, (i) a portion thereof is soluble in (i.e., extracted by) an extraction solvent, and (ii) a portion thereof, which is to be expanded, is insoluble in (i.e., not extracted by) the extraction solvent. Typical extracted tobacco materials include components of the biopolymer matrix of the tobacco material and other tobacco components which are not extracted by the solvent.

The extraction solvent can vary; and the particular solvent which is selected and the particular extraction conditions depend upon the particular components of the tobacco material which are desired to be extracted. Liquid solvents are particularly preferred. The tobacco material can be subjected to extraction conditions one or more times, using one solvent, a co-solvent mixture or successive extraction steps using different solvents in each successive step.

An especially preferred extraction solvent is a solvent having an aqueous character. Such a solvent consists primarily of water, is normally greater than 90 weight percent water, and can be essentially pure water in certain circumstances. Essentially pure water can include deionized water, distilled water or tap water. Other solvents include organic liquids, such as ethanol, isopropanol, isopropylacetate, hexane, or the like. Co-solvent mixtures of miscible solvents (e.g., a water and ethanol mixture) can be employed.

The amount of tobacco material which is contacted with the extraction solvent can vary. Typically, for a batch-wise extraction using a solvent having an aqueous character, the weight of extraction solvent relative to the tobacco material is greater than 6:1, oftentimes greater than 8:1, and in certain instances greater than 12:1. Typically, for a continuous extraction using a solvent having an aqueous character, the weight of extraction solvent relative to the tobacco material is greater than about 40:1, preferably greater than about 50:1. The amount of solvent relative to tobacco material depends upon factors such as the type of solvent, the temperature at which the extraction is performed, the type or form of tobacco material which is extracted, the manner in which contact of the tobacco and solvent is conducted, the type of extraction process which is performed, and other such factors. The manner for contacting the tobacco material with the extraction solvent is not particularly critical, and as such, the tobacco material can be extracted in either a continuous or batch-wise manner. If desired, a portion of tobacco extract can be redistributed onto the extracted tobacco material. Representative methods for extracting tobacco components from a tobacco material, and for redistributing a portion of the tobacco extract onto the resulting extracted tobacco material, are set forth in U.S. patent application Ser. Nos. 392,519, filed Aug. 10, 1989 and 484,587, filed Feb. 23, 1990.

The conditions under which the extraction is performed can vary. For a solvent having an aqueous character, typical temperatures range from about 5° C. to about 75° C., with about 10° C. to about 60° C. being preferred, about 15° C. to about 35° C. being more preferred, and ambient temperature being particularly preferred. The solvent/tobacco material mixture can be agitated (e.g., stirred, shaken or otherwise mixed) in order to increase the rate at which extraction occurs.

A wide variety of components can be extracted from the tobacco material. The particular components and the amounts of the particular components which are extracted often depend upon the type of tobacco material which is processed, the properties of the particular solvent, and the extraction conditions (e.g., which include the temperature at which the extraction occurs as well as the time period over which the extraction is carried out). For example, an extraction solvent consisting essentially of pure water will most often extract primarily the water soluble components of the tobacco material, while a co-solvent mixture of water and a minor amount of an alcohol can extract the water soluble components of the tobacco material as well as certain amounts of tobacco components having other solubility characteristics.

The extraction solvent and tobacco extract therewithin then are separated from the extracted tobacco material (i.e., the insoluble tobacco residue). The manner of separation can vary; however, it is convenient to employ conventional separation techniques using presses, filters, centrifuges, screw presses, rotating disk presses, converging belts, or the like. Preferably, the insoluble residue is treated so as to remove a predetermined amount of solvent and tobacco extract therefrom.

The solvent and tobacco components extracted thereby can be filtered to remove suspended insoluble particles; concentrated; diluted with solvent; or spray dried, freeze dried, or otherwise processed, particularly for storage or handling reasons. If desired, the tobacco extract can be processed in order to alter its chemical nature. The tobacco extract can be retained for later use in the manufacture of smoking articles.

The extracted tobacco material is treated so as to remove a desired amount of remaining extraction solvent therefrom. In particular, essentially all of the solvent or a relatively minor amount of the solvent can be separated from the extracted tobacco material. Typically, the extraction solvent is vaporized by heating the extracted tobacco material (e.g., in a hot air column, rotary dryer, apron dryer, or the like). The extracted tobacco material can be air dried, if desired.

The amount of tobacco extract (i.e., tobacco extractables) separated from the extracted tobacco material can vary, depending upon factors such as the extraction solvent, the extraction conditions, and the separation conditions. Typically, at least about 10 percent, preferably at least about 20 percent, more preferably at least about 30 percent, and most preferably at least about 35 percent, of the weight of the starting tobacco material (on a dry weight basis) is extracted from the starting tobacco material and separated from the extracted tobacco material. For example, when the extraction solvent is a solvent having an aqueous character, it is preferable that at least about 35 percent, and even at least about 40 percent, of the weight of the starting tobacco material (on a dry weight basis) be extracted from the starting tobacco material and separated from the extracted tobacco material.

The extracted tobacco material is provided at a moisture level suitable for expansion treatment. Typically, the extracted tobacco material is provided at a moisture level of about 15 to about 50 weight percent, often about 18 to about 40 weight percent, and preferably about 23 to about 35 weight percent. If desired, the extracted tobacco material can be provided in a fairly low moisture form when the solvent is removed therefrom, and the dry tobacco material can be reordered to a desired moisture level. Generally, an extracted tobacco material is of a moisture level sufficient (i) to promote impregnation of the tobacco material by expansion agent, and (ii) to provide for an extracted tobacco material which expands readily and does not exhibit a tendency to shrink after it is expanded. Techniques for conditioning the extracted tobacco material or otherwise providing the extracted tobacco material at the desired moisture level will be apparent to the skilled artisan. In certain circumstances, certain amounts of residual solvent or co-solvent components can optimize the degree to which the extracted tobacco material is volume expanded.

The extracted tobacco material is contacted with a humectant. For purposes of the present invention, the term "humectant" means a substance which absorbs or retains moisture. Examples of suitable humectants are organic compounds including the polyhydric alcohols (e.g., glycerin, propylene glycol, ethylene glycol, triethylene glycol), as well as sorbitol, or combinations thereof. The amount of humectant normally applied to the extracted tobacco material is less than about 15 percent, and preferably ranges from about 1 to about 12 percent, more preferably about 2 to about 10 percent, based on the dry weight of the extracted tobacco material. It is believed that the humectant replaces to some degree the tobacco components extracted from the tobacco material so as to provide pliability and elasticity to the extracted tobacco material, and hence decrease the brittleness of that tobacco material.

The manner in which the humectant is contacted with the extracted tobacco material can vary. The humectant can be contacted with the tobacco material at later stages of the extraction process or after the extracted tobacco material has been provided. For example, the humectant can be applied to extracted tobacco material in a conventional tumbling drum using a spray nozzle; the apparatus described in U.S. Pat. No. 4,887,619 to Burcham et al; or using a casing cylinder commercially available from Hauni-Werke Korber & Co. KG to spray the humectant to extracted tobacco material on a moving conveyor belt. Other techniques for applying humectant to the extracted tobacco material will be apparent to the skilled artisan. Oftentimes, the humectant can be diluted in a diluent, such as water, prior to being applied to the extracted tobacco material. In addition, common casing flavoring agents (e.g., cocoa and licorice) can be applied to the tobacco material along with the humectant. The selection of the particular casing flavoring agents can vary, and is not particularly critical.

The tobacco material can be conditioned so as to have a desired moisture content when it is subjected to volume expansion conditions. Techniques for providing a tobacco material at a desired moisture level will be apparent to the skilled artisan. For certain expansion processes, the extracted tobacco material is provided at a moisture level of about 15 to about 50 percent, based on the total weight of the extracted tobacco material and moisture.

The extracted tobacco material is subjected to volume expansion conditions. Various methods for volume expanding tobacco materials are described in U.S. Pat. Nos. Re. 30,693 to Fredrickson; Re. 32,013 to de la Burde et al; Re. 32,014 to Sykes et al; 3,524,452 to Moser et al; 3,575,178 to Stewart; 3,683,937 to Fredrickson et al; 3,771,533 to Armstrong et al; 3,828,797 to Newmann et al; 3,842,846 to Laszlo; 3,881,498 to Wochnowski; 4,235,250 to Utsch; 4,243,056 to de la Burde et al; 4,248,252 to Lendvay et al; 4,250,898 to Utsch et al; 4,258,729 to de la Burde et al; 4,271,852 to Glock; 4,308,876 to Rothchild; 4,333,483 to de la Burde et al; 4,366,825 to Utsch et al; 4,377,173 to Rothchild; 4,388,932 to Merritt et al; 4,460,000 to Steinberg; 4,519,407 to Hellier; 4,523,598 to Weiss et al; 4,528,994 to Korte et al; 4,531,529 to White et al; 4,561,453 to Rothchild; 4,577,646 to Ziehn; 4,641,655 to Hedge et al; 4,696,313 to Brown et al; 4,766,912 to Hackman et al; 4,870,980 to Lowry; as well as U.S. patent application Ser. Nos. 367,589, filed June 19, 1989; 395,877, filed Aug. 18, 1989; and 459,007, filed Dec. 29, 1989. The foregoing patent references are incorporated herein by reference for purposes of setting forth representative methods for expanding tobacco materials. Other methods for volume expanding tobacco materials will be apparent to the skilled artisan.

One method for volume expanding the extracted tobacco material involves contacting that material with expansion agent, and then releasing the expansion agent from contact with the extracted tobacco material under conditions sufficient to expand the extracted tobacco material. Preferably, the expansion agent is different from the extraction solvent which is employed to provide the extracted tobacco material. Typical expansion agents include halocarbons and halogenated hydrocarbons, such as CFC 11 and HCFC 123. Typical contact of the extracted tobacco material with the expansion agent impregnates the extracted tobacco material, and typically the contact is provided while the expansion agent is pressurized at a pressure of greater than about 10 psi, frequently greater than about 15 psi. Typical release of the expansion agent impregnated within the tobacco material is such that the expansion agent is released (e.g., volatilized) rapidly, thereby expanding the cell structure of the tobacco material. Release of the impregnated expansion agent normally is performed at elevated temperatures, and the resulting expanded tobacco material is subjected to contact with a gaseous agent, such as steam, under conditions sufficient to vaporize the expansion agent. See, for example, U.S. Pat. No. 3,524,452 to Moser et al.

Another method for volume expanding the extracted tobacco material involves contacting that material with expansion agent (e.g., propane) at a pressure above about 4.5 $Kg/cm^2$ below the critical pressure of that expansion agent (normally at a temperature above the critical temperature of the expansion agent and at a pressure above the critical pressure of the expansion agent), and then decreasing the pressure of the expansion agent under conditions sufficient to expand the extracted tobacco material. See, for example, U.S. Pat. No. 4,531,529 to White et al.

Yet another method for volume expanding the extracted tobacco material involves contacting that material with liquid (e.g., supercooled) carbon dioxide so as to impregnate that material with the liquid carbon dioxide, subjecting the impregnated tobacco material to conditions sufficient to convert at least a portion (e.g., a substantial amount) of the liquid carbon dioxide to solid carbon dioxide to provide a solid carbon dioxide-containing tobacco material, and subjecting the solid carbon dioxide-containing tobacco material to conditions sufficient to vaporize the solid carbon dioxide so as to expand the tobacco material. See, for example, U.S. Pat. Nos. Re. 32,013 to de la Burde et al; Re. 32,014 to Sykes et al; 4,308,876 to Rothchild and 4,377,173 to Rothchild. See also, U.S. Pat. Nos. 4,165,012 to Markwood; 4,295,337 to Johnson et al; 4,307,735 to Snow et al; 4,312,369 to Mullen et al; and 4,366,825 to Banyasz.

The tobacco material which has been expanded is collected, and normally is conditioned using conventional techniques. As such, an expanded tobacco material is collected for use in cigarette manufacture. Typically, the volume expanded tobacco material is provided so as to have a moisture content of about 11 to about 13 weight percent for use in cigarette manufacture. For example, volume expanded extracted tobacco material in cut filler form is blended with a blend of other tobacco materials in cut filler form; and the resulting blend is used as smokable material for cigarette manufacture. For example, a smokable blend including the volume expanded extracted tobacco material can be employed to provide a smokable rod and used to provide a cigarette as described in U.S patent application Ser. No. 414,835, filed Sept. 29, 1989. Alternatively, the volume expanded extracted material can be used as cut filler in the manner described in U.S. patent application Ser. No. 378,551, filed July 11, 1989. The process of the present invention is useful for providing expanded tobacco cut filler which is provided from extracted tobacco material of relatively small size. Further, the expanded tobacco materials of the present invention are useful for providing firm, light-weight smokable tobacco rods for cigarette manufacture.

For purposes of the present invention, the filling capacity of a particular expanded tobacco material is determined by charging the material of a known weight into a tube having a height of about 200 mm and an inner diameter of about 96 mm. Typically, enough expanded tobacco material is employed to fill the tube about ¾ full. A piston having a height of about 170 mm and an outer diameter of about 93.5 mm includes a support housing such that the piston and housing weighs about 26 pounds. The piston is lowered onto the tobacco material and is allowed to rest thereon. After the piston and housing rests on the tobacco material for 5 seconds, the volume occupied by that material within the cylinder is recorded. Typical high filling capacity values for tobacco materials which are expanded according to the process of the present invention are greater than about 900, preferably are greater than 1,000, frequently are greater than 1,100, often are greater than 1,200, sometimes are greater than 1,300 and occasionally are greater than about 1,400. Such filling capacity values are reported in units of milliliters per 2.3 psi per 100 g of tobacco material at 12 weight percent moisture at 76° F. (24.4° C.) as determined using the previously described procedure.

The following examples are provided in order to further illustrate various embodiments of the invention but should not be construed as limiting the scope thereof. Unless otherwise noted, all parts and percentages are by weight.

EXAMPLE 1

Aged flue-cured tobacco cut filler (i.e., strands or shreds of tobacco laminae at 32 cuts per inch) is provided. The tobacco cut filler has a filling capacity of about 600 ml per 2.3 psi per 100 g tobacco material at 12 weight percent moisture at 76° F.

The cut filler is extracted using tap water at about 140° F. by continuously contacting that cut filler with water in an extraction tank such that each part of cut filler is contacted on average with about 50 parts of water. Extracted tobacco material is separated from the slurry which results using a belt washer to provide extracted tobacco material having a moisture content of about 90 percent. The moist extracted tobacco material then has further aqueous tobacco extract removed therefrom by passing that material through a disk press so as to provide an extracted tobacco material having a moisture content of about 75 percent. As such, about 89 percent of the water extractables are removed from the tobacco material. The moist extracted tobacco material is dried at elevated temperatures in a steam heated rotary dryer to a moisture content of about 25 percent.

The extracted tobacco material, having a moisture content of about 25 percent, is fed continuously into an extraction tank and is continuously extracted with water at about 140° F. such that each part of tobacco material is contacted on average with about 50 parts of water. Extracted tobacco material is separated from the slurry which results using a belt washer to provide extracted tobacco material having a moisture content of about 90 percent.

Glycerin is sprayed onto the moist extracted tobacco material while that material is on a moving belt. The glycerin is applied as a spray in the form of a mixture of about 50 parts water and about 50 parts glycerin. The moist extracted tobacco material then is dried in a rotary dryer to a moisture content of about 25 percent. Then, the extracted tobacco material is dried at elevated temperatures using a steam heated apron dryer to a moisture content of about 12 percent.

The resulting extracted tobacco material has about 92 percent of the water extractables removed therefrom, and is in contact with about 5 percent glycerin, on a dry weight basis. The resulting extracted tobacco material has a filling capacity of about 400 ml per 2.3 psi per 100 g material at 12 weight percent moisture at 76° F.

The extracted tobacco material is subjected to volume expansion conditions using the G-13 processing facilities of R. J. Reynolds Tobacco Co. The extracted tobacco material is adjusted to about 25 to about 30 percent moisture and introduced into an impregnation chamber at a rate of about 15,000 lb./hr. Into the chamber is introduced Freon 11 to contact the tobacco material such that the pressure in the chamber is about 19 psi and the temperature is about 120° F. The resulting impregnated tobacco material is introduced into an expansion column maintained at about 335° F. and experiencing about 8,000 lb./hr. flow of steam. The resulting material then is passed through a stripping drum maintained at about 210° F. and experiencing about 250 lb./hr. flow of steam; and then is conditioned in a conditioning drum at about ambient temperature. The conditioned, expanded tobacco material which is collected has a moisture content of about 12.5 percent. The expanded tobacco material exhibits a filling capacity of about 1,200 ml per 2.3 psi per 100 g material at 12 weight percent moisture at 76° F.

EXAMPLE 2

Aged flue-cured tobacco cut filler of the type described in Example 1 is extracted with water generally in the manner set forth in Example 1. The extracted tobacco material is dried in a rotary dryer to a moisture content of about 12 percent. Then, a casing mixture of flavors, water and glycerin is applied to the tobacco material using a casing cylinder. The tobacco material is conditioned and reordered to a moisture content of about 25 percent. The resulting tobacco material is in contact with about 3.7 percent glycerin, on a dry weight basis. The resulting cased extracted tobacco material has a filling capacity of less than about 700 ml per 2.3 psi per 100 g material at 12 weight percent moisture at 76° F.

The extracted tobacco material, having a moisture content of about 25 percent, is subjected to volume expansion conditions generally in the manner set forth in Example 1. However, during the 1 hour period that the tobacco material is introduced into the impregnation chamber, the pressure within the chamber is gradually reduced from about 20 psi to about 4 psi. The conditioned, expanded tobacco material which is collected has a moisture content of about 12.5 percent. The expanded tobacco material which is collected exhibits a filling capacity ranging from about 1,444 (for the expanded tobacco material which is collected initially) to about 929 (for the expanded tobacco material which is last to be collected). Filling capacity values are provided in units of ml per 2.3 psi per 100 g material at 12 weight percent moisture at 76° F.

What is claimed is:

1. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted material with humectant;

(d) contacting the extracted tobacco material with expansion agent; and (e) releasing the expansion agent from contact with the extracted tobacco material under conditions sufficient to expand the extracted tobacco material.

2. The process of claim 1 whereby the solvent is a liquid having an aqueous character.

3. The process of claim 2 wherein at least about 40 percent by weight of the tobacco material is separated as extract from the extracted tobacco material in step (b).

4. The process of claim 2 whereby, after step (b) but prior to step (d), the extracted tobacco material is provided at a moisture level of about 15 percent to about 50 percent, based on the total weight of the extracted tobacco material and moisture.

5. The process of claim 1 whereby, after step (b) but prior to step (c), the extracted tobacco material is provided at a moisture level of about 15 percent to about 50 percent, based on the total weight of the extracted tobacco material and moisture.

6. The process of claim 1 whereby the volume expansion conditions are such that the extracted tobacco material exhibits a filling capacity of greater than about 900 ml per 2.3 psi per 100 g of extracted tobacco material at 12 weight percent moisture at 76° F.

7. The process of claim 1 whereby the volume expansion conditions are such that the extracted tobacco material exhibits a filling capacity of greater than about 1,000 ml per 2.3 psi per 100 g of extracted tobacco material at 12 weight percent moisture at 76° F.

8. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted tobacco material with expansion agent;

(d) releasing the expansion agent from contact with the extracted tobacco material under conditions sufficient to expand the extracted tobacco material to yield an extracted tobacco material exhibiting a filling capacity of greater than about 900 ml per 2.3 psi per 100 g of extracted tobacco material at 12 weight percent moisture at 76° F.

9. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted tobacco material with expansion agent;

(d) releasing the expansion agent from contact with the extracted tobacco material under conditions sufficient to expand the extracted tobacco material to yield an extracted tobacco material exhibiting a filling capacity of greater than about 1,000 ml per 2.3 psi per 100 g of extracted tobacco material at 12 weight percent moisture at 76° F.

10. The process of claim 1, 8 or 9 whereby at least about 20 percent by weight of the tobacco material is separated as extract from the extracted tobacco material in step (b).

11. The process of claim 1, 8 or 9 whereby at least about 30 percent by weight of the tobacco material is separated as extract from the extracted tobacco material in step (b).

12. A process for increasing the filling power of a tobacco material, the process comprising the steps of:

(a) extracting tobacco using a solvent to provide (i) a tobacco extract within the solvent, and (ii) an extracted tobacco material;

(b) separating the extracted tobacco material from at least a portion of the extract and solvent;

(c) contacting the extracted tobacco material with humectant;

(d) contacting the extracted tobacco material with expansion agent at a pressure above about 4.5 $Kg/cm^2$ below the critical pressure of the expansion agent; and (e) decreasing the pressure of the expansion agent under conditions sufficient to expand the extracted tobacco material.

13. The process of claim 12 whereby the expansion agent includes propane.

14. The process of claim 12 whereby the extracted tobacco material is contacted with expansion agent (i) at a temperature above the critical temperature of the expansion agent, and (ii) at a pressure above the critical pressure of the expansion agent.

15. The process of claim 12, 13 or 14 whereby the solvent is a liquid having an aqueous character.

16. The process of claim 15 wherein at least about 40 percent by weight of the tobacco material is separated as extract from the extracted tobacco material in step (b).

17. The process of claim 12 whereby the volume expansion conditions are such that the extracted tobacco material exhibits a filling capacity of greater than about 900 ml per 2.3 psi per 100 g of extracted tobacco material at 12 weight percent moisture at 76° F.

18. The process of claim 12 whereby at least about 20 percent by weight of the tobacco material is separated as extract from the extracted tobacco material in step (b).

19. The process of claim 12 whereby at least about 30 percent by weight of the tobacco material is separated as extract from the extracted tobacco material in step (b).

20. A process for increasing the filling power of a tobacco material, the process comprising the steps of:

(a) extracting tobacco using a solvent to provide (i) a tobacco extract within the solvent, and (ii) an extracted tobacco material;

(b) separating the extracted tobacco material from at least a portion of the extract and solvent;

(c) contacting the extracted tobacco material with humectant;

(d) contacting the extracted tobacco material with expansion agent under conditions sufficient to impregnate the extracted tobacco material with the expansion agent; and (e) contacting the extracted tobacco material impregnated with expansion agent with a gaseous agent under conditions sufficient to vaporize the expansion agent and to expand the extracted tobacco material.

21. The process of claim 20 whereby the expansion agent is an organic expansion agent.

22. The process of claim 20 whereby the expansion agent includes a hydrocarbon.

23. The process of claim 20 whereby the expansion agent includes a halogenated hydrocarbon.

24. The process of claim 20 whereby the solvent is a liquid having an aqueous character.

25. The process of claim 24 wherein at least about 40 percent by weight of the tobacco material is separated as extract from the extracted tobacco material in step (b).

26. The process of claim 24 whereby, after step (b) but prior to step (d), the extracted tobacco material is provided at a moisture level of about 15 percent to about 50 percent, based on the total weight of the extracted tobacco material and moisture.

27. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted tobacco material with expansion agent under conditions sufficient to impregnate the extracted tobacco material with the expansion agent; and;

(d) contacting the extracted tobacco material impregnated with expansion agent with a gaseous agent under conditions sufficient to vaporize the expansion agent and to expand the extracted tobacco material to yield an extracted tobacco material exhibiting a filling capacity of greater than about 900 ml per 2.3 psi per 100 g of extracted tobacco material at 12 weight percent moisture at 76° F.

28. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted tobacco material with expansion agent under conditions sufficient to impregnate the extracted tobacco material with the expansion agent; and (d) contacting the extracted tobacco material impregnated with expansion agent with a gaseous agent under conditions sufficient to vaporize the expansion agent and to expand the extracted tobacco material to yield an extracted tobacco material exhibiting a filling capacity of greater than about 1,000 ml per 2.3 psi per 100 g of extracted tobacco material at 12 weight percent moisture at 76° F.

29. The process of claim 20, 27 or 28 whereby at least about 20 percent by weight of the tobacco material is separated as extract from the extracted tobacco material in step (b).

30. The process of claim 20, 27 or 28 whereby at least about 30 percent by weight of the tobacco material is separated as extract from the extracted tobacco material in step (b).

31. A process for increasing the filling power of a tobacco material, the process comprising the steps of:

(a) extracting tobacco using a solvent to provide (i) a tobacco extract within the solvent, and (ii) an extracted tobacco material;

(b) separating the extracted tobacco material from at least a portion of the extract and solvent;

(c) contacting the extracted tobacco material with humectant;

(d) contacting the extracted tobacco material with liquid carbon dioxide so as to impregnate the extracted tobacco material with liquid carbon dioxide;

(e) subjecting the extracted tobacco material impregnated with liquid carbon dioxide to conditions sufficient to convert at least a portion of the liquid carbon dioxide to solid carbon dioxide; and (f) subjecting the extracted tobacco material of step (e) to conditions sufficient to vaporize the solid carbon dioxide so as to expand the extracted tobacco material.

32. The process of claim 31 whereby the solvent is a liquid having an aqueous character.

33. The process of claim 32 wherein at least about 40 percent by weight of the tobacco material is separated as extract from the extracted tobacco material in step (b).

34. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted tobacco material with liquid carbon dioxide so as to impregnate the extracted tobacco material with liquid carbon dioxide;

(d) subjecting the extracted tobacco material impregnated with liquid carbon dioxide to conditions sufficient to convert at least a portion of the liquid carbon dioxide to solid carbon dioxide; and (e) subjecting the extracted tobacco material of step (d) to conditions sufficient to vaporize the solid carbon dioxide so as to expand the extracted tobacco material to yield an extracted tobacco material exhibiting a filling capacity of greater than about 900 ml per 2.3 psi per 100 g of extracted tobacco material at 12 weight percent moisture at 76° F.

35. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) subjecting the extracted tobacco material impregnated with liquid carbon dioxide to conditions sufficient to convert at least a portion of the liquid carbon dioxide to solid carbon dioxide; and (d) subjecting the extracted tobacco material of step (d) to conditions sufficient to vaporize the solid carbon dioxide so as to expand the extracted tobacco material to yield an extracted tobacco material exhibiting a filling capacity of greater than about 1,000 ml per 2.3 psi per 100 g of extracted tobacco material at 12 weight percent moisture at 76° F.

36. The process of claim 30, 34 or 35 at least about 20 percent by weight of the tobacco material is separated as extracted from the extracted tobacco material in step (b).

37. The process of claim 30, 34 or 35 whereby at least about 30 percent by weight of the tobacco material is separated as extract from the extracted tobacco material in step (b).

38. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted tobacco material with humectant; and (d) subjecting the extracted tobacco material to volume expansion conditions sufficient to expand that material such that the material exhibits a filling capacity of greater than about 900 ml per 2.3 psi per 100 g of extracted tobacco material at 12 weight percent moisture at 76° F.

39. The process of claim 38 whereby the solvent is a liquid having an aqueous character.

40. The process of claim 39 whereby at least about 20 percent by weight of the tobacco material is separated as extract from the extracted tobacco material in step (b).

41. The process of claim 39 whereby at least about 30 percent by weight of the tobacco material is separated as extract from the extracted tobacco material in step (b).

42. The process of claim 39 wherein at least about 40 percent by weight of the tobacco material is separated as extract from the extracted tobacco material in step (b).

43. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent; and (c) subjecting the extracted tobacco material to volume expansion conditions sufficient to expand that material such that the material exhibits a filling capacity of greater than about 1,000 ml per 2.3 psi per 100 g of extracted tobacco material at 12 weight percent moisture at 76° F.

44. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent; and (c) subjecting the extracted tobacco material to volume expansion conditions sufficient to expand that material such that the material exhibits a filling capacity of greater than about 1,100 ml per 2.3 psi per 100 g of extracted tobacco material at 12 weight percent moisture at 76° F.

45. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent; and (c) subjecting the extracted tobacco material to volume expansion conditions sufficient to expand that material such that the material exhibits a filling capacity of greater than about 1,200 ml per 2.3 psi per 100 g of extracted tobacco material at 12 weight percent moisture at 76° F.

46. The process of claim 37, 43, 44 or 45 whereby at least about 20 percent by weight of the tobacco material is separated as extract from the extracted tobacco material in step (b).

47. The process of claim 37, 43, 44 or 45 whereby at least about 30 percent by weight of the tobacco material is separated as extract from the extracted tobacco material in step (b).

48. A process for increasing the filling power of a tobacco material, the process comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) contacting the extracted tobacco material with expansion agent at a pressure above 4.5 $Kg/cm^2$ below the critical pressure of the expansion agent; and (d) decreasing the pressure of the expanded agent under conditions sufficient to expand the extracted tobacco material such that the extracted tobacco material exhibits a filling capacity of greater than about 900 ml per 2.3 psi per 100 g of extracted tobacco material at 12 weight percent moisture at 76° F.

49. The process of claim 48 whereby at least about 20 percent by weight of the tobacco material is separated as extract from the extracted tobacco material in step (b).

50. The process of claim 48 whereby at least about 30 percent by weight of the tobacco material is separated as extract from the extracted tobacco material in step (b).

* * * * *